US007925182B2

(12) United States Patent
Ishiguro et al.

(10) Patent No.: US 7,925,182 B2
(45) Date of Patent: Apr. 12, 2011

(54) IMAGE FORMING APPARATUS

(75) Inventors: Yasuyuki Ishiguro, Higashiosaka (JP); Hiroshi Tanisawa, Nara (JP); Hiroshi Kawahito, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 343 days.

(21) Appl. No.: 12/199,343

(22) Filed: Aug. 27, 2008

(65) Prior Publication Data

US 2009/0060585 A1 Mar. 5, 2009

(30) Foreign Application Priority Data

Aug. 28, 2007 (JP) ..... 2007-221668

(51) Int. Cl.
*G03G 21/18* (2006.01)

(52) U.S. Cl. ..... 399/113; 399/114; 399/258

(58) Field of Classification Search ..... 399/110, 399/113, 114, 120, 258, 260
See application file for complete search history.

(56) References Cited

U.S. PATENT DOCUMENTS

| | | | | |
|---|---|---|---|---|
| 7,747,198 | B2 * | 6/2010 | Nakagami | 399/260 |
| 2007/0059045 | A1 | 3/2007 | Kubota et al. | |
| 2009/0035012 | A1 * | 2/2009 | Horikawa | 399/119 |

FOREIGN PATENT DOCUMENTS

| | | |
|---|---|---|
| JP | 6-035321 | 2/1994 |
| JP | 2007-078848 | 3/2007 |

* cited by examiner

*Primary Examiner* — David M Gray
*Assistant Examiner* — Barnabas T Fekete
(74) *Attorney, Agent, or Firm* — Renner, Otto, Boisselle & Sklar, LLP

(57) ABSTRACT

A communication unit has a first conveyance part connected to a toner cartridge and provided with a feed port for a toner from the toner cartridge, and a second conveyance part connected to a developing device and provided with a replenishment port for a toner to the developing device. In a state locked by the lock mechanism, the first conveyance part and the second conveyance part are connected to each other, and the feed port of the first conveyance part and the replenishment port of the second conveyance part are opened, allowing for a toner replenishment. In a lock-released state, the feed port of the first conveyance part and the replenishment port of the second conveyance part are closed by a circular arc-shaped shutter member and a rotary shutter member, allowing the first conveyance part and the second conveyance part to be separable from each other.

9 Claims, 14 Drawing Sheets

IMAGE FORMING APPARATUS

CROSS-REFERENCE TO RELATED APPLICATION

This application claims priority to Japanese Patent Application No. 2007-221668, which was filed on Aug. 28, 2007, the contents of which are incorporated herein by reference in its entirety.

BACKGROUND OF THE INVENTION

1. Field of the Invention

The present invention relates to an electrophotographic image forming apparatus.

2. Description of the Related Art

Electrophotographic image forming apparatuses can form high-quality images with simple operations in a short time, and they are also easy to maintain and manage. For these reasons, electrophotographic image forming apparatuses are in widespread use as, for example, photocopiers, printers, and facsimile machines. An electrophotographic image forming apparatus (hereinafter simply referred to as an "image forming apparatus") has, for example, a photoreceptor, an electrostatic charging section, an exposure section, a developing section, a transfer section, and a fixing section. The photoreceptor is a roller-like member having a surface on which a photosensitive film is formed. The electrostatic charging section is energized with voltage and thereby charges the photoreceptor surface to a predetermined potential. The exposure section irradiates the charged photoreceptor surface with signal light according to image information to form an electrostatic latent image. The developing section feeds a toner to the electrostatic latent image to develop a toner image on the photoreceptor surface. The transfer section transfers the toner image on the photoreceptor surface to a recording medium. The fixing section includes, for example, a fixing roller that has a heating part therein, and a pressure roller that is in pressure contact with the fixing roller. The recording medium that carries the un-fixed toner image passes through the pressure-contact portion of the fixing roller and the pressure roller, whereby the toner image is thermally fixed to the recording medium. An image is thus printed on the recording medium.

The developing section has a developing roller opposed to the photoreceptor which rotates with an electrostatic latent image formed thereon, and a developing tank containing a developer. In the developing section, the developer in the developing tank is conveyed by the developing roller toward the photoreceptor, thereby developing the electrostatic latent image on the photoreceptor. Here, in the case where the developer is a two-component developer containing a toner and a carrier, only the toner is used for the development and consumed while the carrier is left in the developing tank. A new toner is replenished into the developing tank by a toner replenishment unit in an amount corresponding to the amount of the consumed toner.

In the case where a two-component developer containing a carrier and a toner for the developing section, it is necessary to mix and agitate the carrier and the toner by an agitating member. The agitating member first performs what is called a preliminary agitation, in which the developer in the developing tank is agitated for a certain time to be electrostatically charged to a predetermined value or higher, before the developing section performs a developing operation. Then, when the developing section starts the developing operation, the developer is fed to the photoreceptor while the developer in the tank is agitated or while the toner replenished from a toner cartridge and the developer in the tank are mixed and agitated. The developer fed to the photoreceptor is used for development of the electrostatic latent image.

The toner replenishment from the toner cartridge to the developing tank is carried out as follows; a feed port on the cartridge side and a replenishment port on the developing tank side are allowed to communicate with each other, and an appropriate amount of a toner is replenished from the cartridge to the developing tank according to predetermined timing.

The feed port on the cartridge side and the replenishment port on the developing tank side are each provided with a shutter, and each shutter opens when replenishing the toner or when the positions of the toner cartridge and the developing tank are fixed in such a state that the toner does not leak out. In addition, the shutter is closed at least when the toner cartridge and the developing tank are detached from each other, so that the toner does not leak out from the feed port and the replenishment port.

In an image forming apparatus disclosed in Japanese Unexamined Patent Publication JP-A 2007-78848, a toner is replenished through a toner conveyance pipe disposed between a toner hopper and a developing tank, and the feed port of the toner conveyance pipe is opened and closed according to a movement of a lever member upon attachment and detachment of a developing device.

A problem with the conventional structure is that a toner leaks out or scatters due to vibration caused by the operation of attaching and detaching the developing device since the shutter opens and closes in conjunction with the attachment and detachment of the developing device.

Further, in a color image forming apparatus, it is common to use developing devices for respective toners of four colors and therefore, in the case where toner containers are located in upper parts of the developing devices, it is difficult to install the developing devices from an upper part of the color image forming apparatus, thus causing a problem that there is no other way but to install the developing devices in an apparatus main unit through a front side thereof.

SUMMARY OF THE INVENTION

It is an object of the invention to provide an image forming apparatus capable of reliably preventing a toner from leaking and scattering.

The invention provides an image forming apparatus comprising:

a toner cartridge to store a toner;

a developing device to develop an electrostatic latent image formed on a surface of a photoreceptor by the toner; and a toner conveyance unit to replenish a toner from the toner cartridge to the developing device, the image forming apparatus forming an image by transferring and fixing a developed toner image onto a recording medium, the toner conveyance unit having a first conveyance part connected to the toner cartridge and provided with a feed port for a toner from the toner cartridge, and a second conveyance part connected to the developing device and provided with a replenishment port for a toner to the developing device, the toner conveyance unit being adapted to be separable into an apparatus upper portion including the toner cartridge and the first conveyance part and an apparatus lower portion including the developing device and the second conveyance part, the toner conveyance unit including a lock mechanism to lock the apparatus upper portion and apparatus lower portion closed, in a state locked by the lock mechanism, the first conveyance part and the second conveyance part being connected to each other, and the feed port of the first conveyance part and the replenishment port of the second conveyance part are opened by shutter members, allowing for a toner replenishment, and in a lock-released state, the feed port of the first conveyance part and the replenishment port of the second conveyance part being closed by the shutter members, allowing the first conveyance part and the second conveyance part to be separable from each other.

According to the invention, the image forming apparatus has a toner cartridge to store a toner, a developing device to develop an electrostatic latent image formed on a photoreceptor surface by the toner, and a toner conveyance unit to replenish the toner from the toner cartridge to the developing device, and the image forming apparatus forms an image by transferring and fixing a developed toner image onto a recording medium.

The toner conveyance unit has a first conveyance part connected to the toner cartridge and provided with a feed port for a toner from the toner cartridge, and a second conveyance part connected to the developing device and provided with a replenishment port for a toner to the developing device.

In a state locked by the lock mechanism, the first conveyance part and the second conveyance part are connected to each other, and the feed port of the first conveyance part and the replenishment port of the second conveyance part are opened by shutter members, allowing for a toner replenishment. In a lock-released state, the feed port of the first conveyance part and the replenishment port of the second conveyance part are closed by the shutter members, allowing the first conveyance part and the second conveyance part to be separable from each other.

When the apparatus upper portion and the apparatus lower portion are separated for maintenance including attachment and detachment of the developing device, the feed port of the first conveyance part and the replenishment port of the second conveyance part have been previously closed in conjunction with the lock release of the lock mechanism, with the result that the toner can be reliably prevented from leaking and scattering.

Further, in the invention, it is preferable that the apparatus upper portion and the apparatus lower portion are separated from each other and the developing device is exposed with the apparatus upper portion opened upward.

According to the invention, the apparatus upper portion and the apparatus lower portion are separated from each other so that the developing device is exposed with the apparatus upper portion opened upward. This allows for replacement of the developing device from above, resulting in high visibility and thus excellence in maintenance such as cleaning.

Further, in the invention, it is preferable that the lock mechanism is coupled to the shutter members on the feed port of the first conveyance part and the replenishment port of the second conveyance part and the shutter members open and close in conjunction with movement of the lock mechanism.

According to the invention, the lock mechanism is coupled to the shutter members on the feed port of the first conveyance part and the replenishment port of the second conveyance part and the shutter members open and close in conjunction with movement of the lock mechanism.

Since drive force for operating the lock mechanism can be directly used as drive force for opening and closing the shutter members, there is no need of increasing rigidity of the toner conveyance unit.

Further, in the invention, it is preferable that the image forming apparatus is of a tandem type with a plurality of toner cartridges and a plurality of developing devices to be capable of forming a color image.

According to the invention, the image forming apparatus is of a tandem type with a plurality of toner cartridges and a plurality of developing devices to be capable of forming a color image.

Further, in the invention, the lock mechanism is coupled via a rod-shaped member to the shutter members on the feed port of the first conveyance part and the replenishment port of the second conveyance part.

According to the invention, the shutter members can work in conjunction with the lock mechanism by such a simple mechanism as a rod-shaped member since the developing devices are linearly disposed in the image forming apparatus of the tandem type.

Further, in the invention, it is preferable that the shutter members are made of a resin material containing a conductive material.

According to the invention, the shutter members are made of a resin material containing a conductive material.

This suppresses electrostatic adhesion of the toner to the shutter members, making conveyance of the toner easy.

Further, in the invention, it is preferable that surfaces of the shutter members each have a 10-point mean surface roughness Rz of 2 μm or less.

According to the invention, surfaces of the shutter members each have a 10-point mean surface roughness Rz of 2 μm or less.

This suppresses adhesion of the toner with a very small particle size to the shutter surface portions, making conveyance of the toner easy.

Further, in the invention, it is preferable that a sealing member having elasticity is provided on surfaces of the shutter members.

According to the invention, a sealing member having elasticity is provided on surfaces of the shutter members.

This prevents the toner from leaking and scattering even when the apparatus is opened to expose an interior thereof for cleaning or replacement of consumables, thus enhancing maintenance ability.

Further, in the invention, it is preferable that a junction of the shutter members has a substantially trapezoidal shape extending in an outer circumferential direction of the shutter members.

According to the invention, a junction of the shutter members has a substantially trapezoidal shape extending in an outer circumferential direction of the shutter members.

This makes it possible to absorb junction misalignment caused when the apparatus upper portion moves to close the apparatus that has become rickety, thus allowing the shutter members to be reliably joined together.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
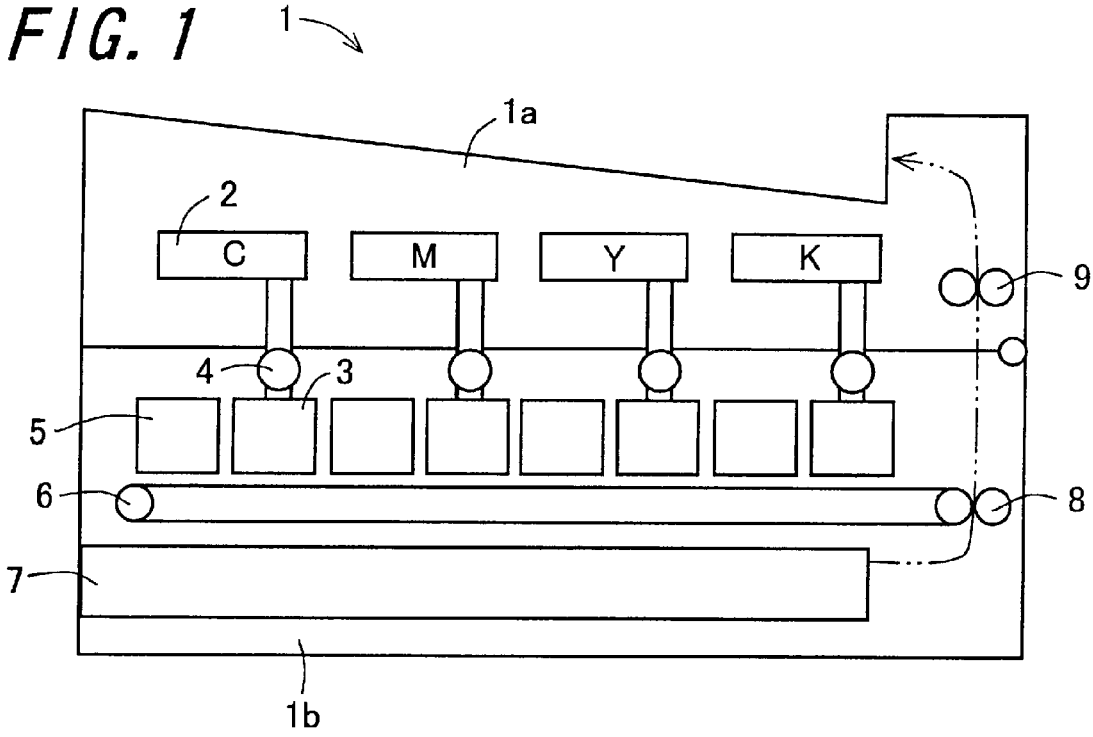
FIG. 1 is a cross-sectional view schematically showing the configuration of an image forming apparatus according to one embodiment of the invention.

Now referring to the drawings, preferred embodiments of the invention are described below.

FIG. 1 is a cross-sectional view schematically showing the configuration of an image forming apparatus 1 according to one embodiment of the invention. In the present embodiment, full-color images can be formed in which four color toners of cyan (C), magenta (M), yellow (Y), and black (K). A tandem type intermediate transfer system is employed, in which the photoreceptor units of respective colors are disposed in the order of CMYK, and developed respective toner images are transferred sequentially to an intermediate transfer belt.

The image forming apparatus 1 is furnished with toner cartridges 2 to store toners for replenishment, developing units 3 to develop an electrostatic latent image of a photoreceptor surface, communication units 4 serving as a toner conveyance unit to replenish toners from the toner cartridges 2 to the developing units 3, photoreceptor units 5 having photoreceptors, an intermediate transfer belt 6 to temporarily overlay and transfer the toner images of respective color toners, a paper feed cassette 7 to store recording sheets, a transfer unit 8 to transfer the overlaid toner image on the intermediate transfer belt to a recording sheet fed from a paper feed cassette, and a fixing unit 9 to fix the transferred toner image onto a recording sheet.

Although the detailed structure of the communication unit 4 will be described later, the communication unit 4 has a first conveyance part 40 connected to a toner cartridge 2 and provided with a shutter, and a second conveyance part 41 connected to the developing unit 3 and provided with a rotary shutter. The first conveyance part 40 and the second conveyance part 41 are adapted to be detachable at the rotary shutter portion.

The image forming apparatus 1 has what is called a clamshell type structure, in which the apparatus can be separated into an upper portion 1*a* and a lower portion 1*b* and the upper portion 1*a* and the lower portion 1*b* are adapted to open and close with a hinge mechanism.

Figure 2:
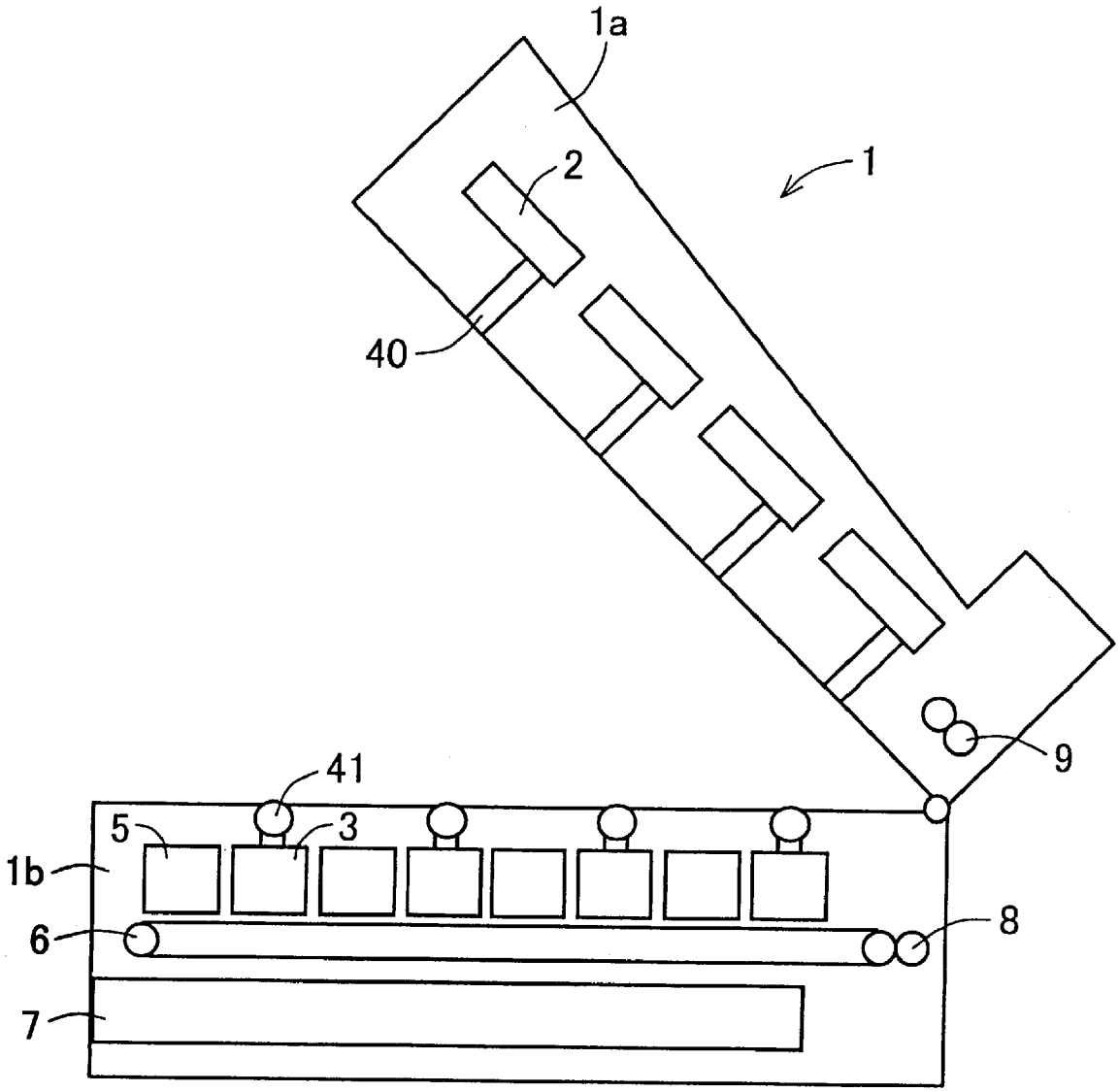
FIG. 2 is a cross-sectional view schematically showing the configuration of the image forming apparatus that is open.

As illustrated in FIG. 2 showing the open state, the toner cartridges 2, the first conveyances part 40 of the communication units 4, and the fixing unit 9 are disposed in the apparatus upper portion 1*a*. In the apparatus lower portion 1*b*, the remaining components are disposed including the second conveyance part 41, the developing units 3, the photoreceptor units 5, the intermediate transfer belt 6, the paper feed cassette 7, and the transfer unit 8.

When the apparatus upper portion 1*a* is angularly displaced by the hinge mechanism to open the apparatus to expose an interior thereof, the shutter of the first conveyance part 40 and the rotary shutter of the second conveyance part 41 are closed in conjunction with the opening operation. This makes it possible to prevent the toner from falling or scatting from the toner cartridge 2 and the developing unit 3 even when the apparatus is opened to expose its interior at the time of maintenance such as repairing, replacement, and cleaning.

Figure 3:
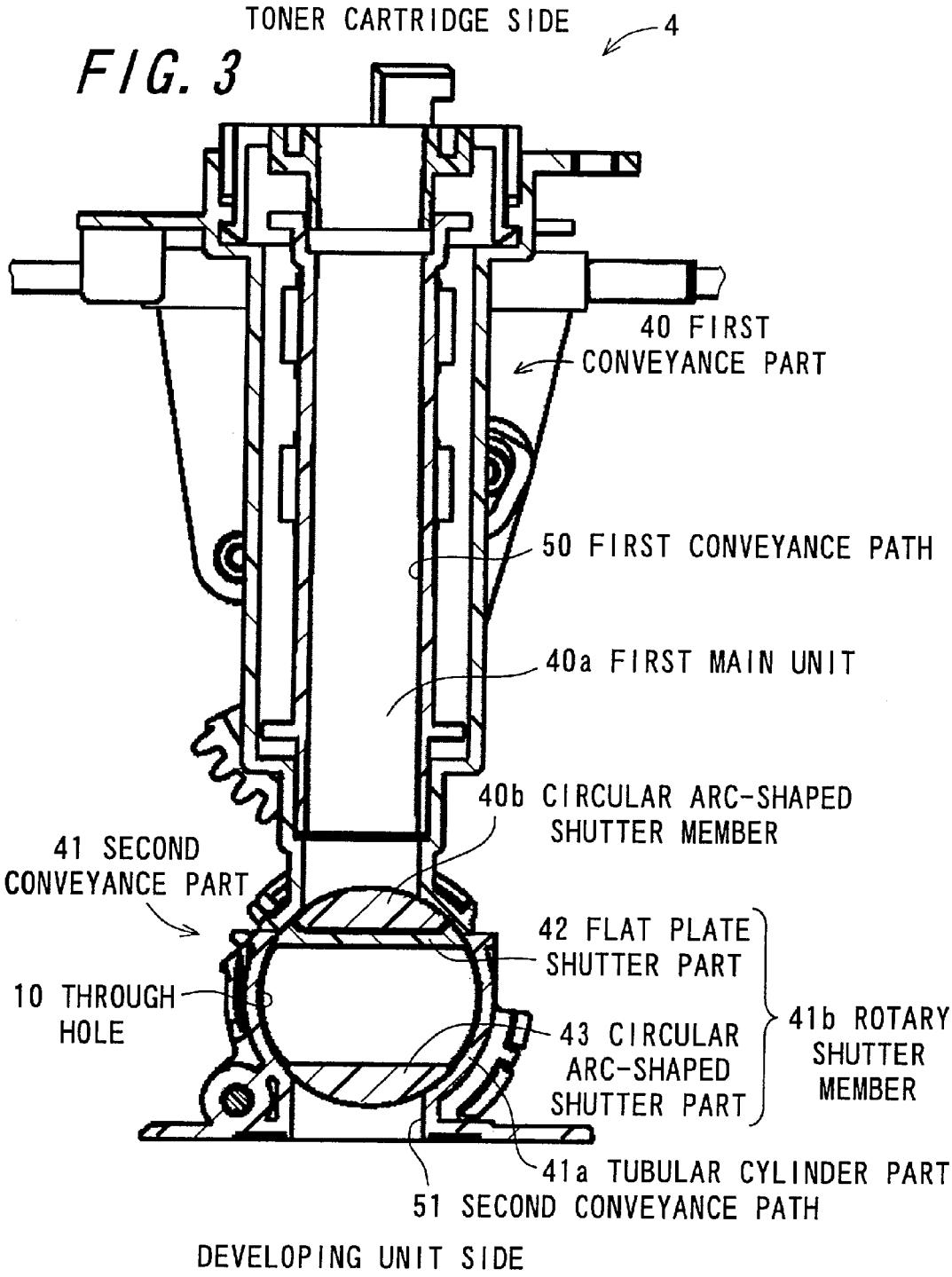
FIG. 3 is a cross-sectional view showing the configuration of a communication unit.

FIG. 3 is a cross-sectional view showing the configuration of the communication unit 4.

As described above, the communication unit 4 includes the first conveyance part 40 and the second conveyance part 41. The first conveyance part 40 has a first main part 40*a* that forms a first conveyance path 50, a circular arc-shaped shutter member 40*b* (first shutter member) provided on the second conveyance part 41-connecting side. The second conveyance part 41 has a tubular cylinder part 41*a* and a rotary shutter member 41*b* that is internally in contact with the tubular cylinder part 41*a* and rotates around the center axis of the tubular cylinder part 41*a*. In The tubular cylinder part 41*a*, a first opening communicating with the conveyance path of the first conveyance part 40 is provided on an outer circumferential surface while a short second conveyance path 51 communicating with the replenishment port of the developing unit 3 is provided on the radially opposite side to the first opening. The rotary shutter member 41*b* is provided with a through hole 10 being internally in contact with the tubular cylinder part 41*a* and penetrating radially. This through hole 10 is such that, by rotation of the rotary shutter member 41*b* in the tubular cylinder part 41*a*, one of the openings meets the first opening of the tubular cylinder part 41*a* while the other opening meets the second conveyance path of the tubular cylinder part 41*a*. The toner for replenishment passes through the first conveyance part 40 and further through the through hole 10, reaching the developing unit 3.

In the rotary shutter member 41*b*, a flat plate shutter part 42 and a circular arc-shaped shutter part 43 are formed on both sides of the outer circumferential portion in a direction perpendicular to the penetrating direction of the through hole 10. The flat plate shutter part 42 and the circular arc-shaped shutter part 43 are provided integrally with the rotary shutter member 41*b*. The flat plate shutter part 42 is adapted to close the first opening in association with rotation of the rotary shutter member 41*b*, and the circular arc-shaped shutter part 43 is adapted to close the second conveyance path 51 in association with rotation of the rotary shutter member 41*b*.

The connection of the first conveyance part 40 and the second conveyance part 41 is performed using the respective shutter members. FIGS. 4 through 7 illustrate the connection state between the first conveyance part 40 and the second conveyance part 41.

Figure 4:
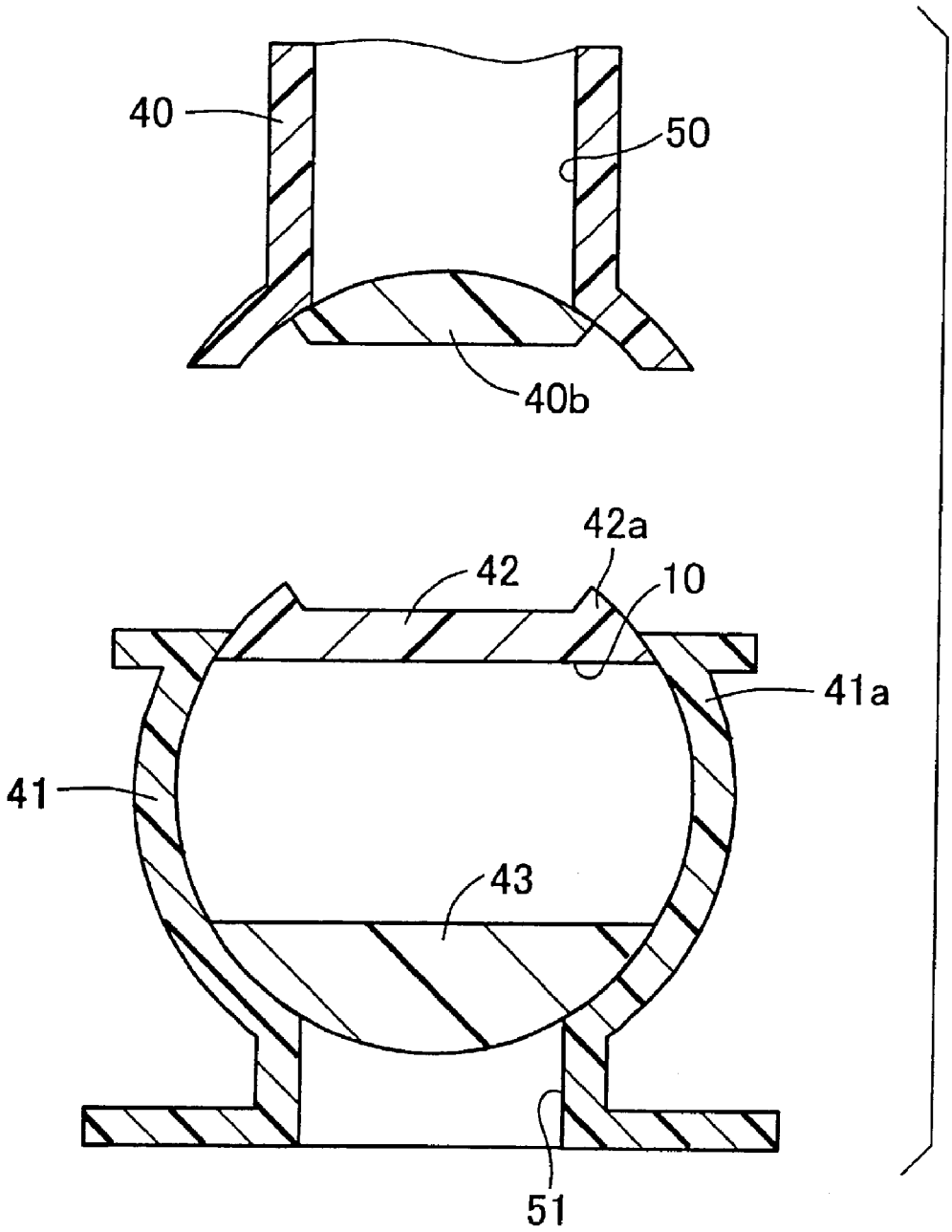
FIG. 4 is a view of assistance in explaining a connection state of a first conveyance part and a second conveyance part.

As illustrated in FIG. 4, in the state in which the first conveyance part 40 and the second conveyance part 41 are detached from each other, the first conveyance path 50 of the first conveyance part 40 is closed by the circular arc-shaped shutter member 40*b*, and the through hole 10 and the second conveyance path 51 of the second conveyance part 41 are closed by the flat plate shutter part 42 and the circular arc-shaped shutter part 43, respectively.

Figure 5:
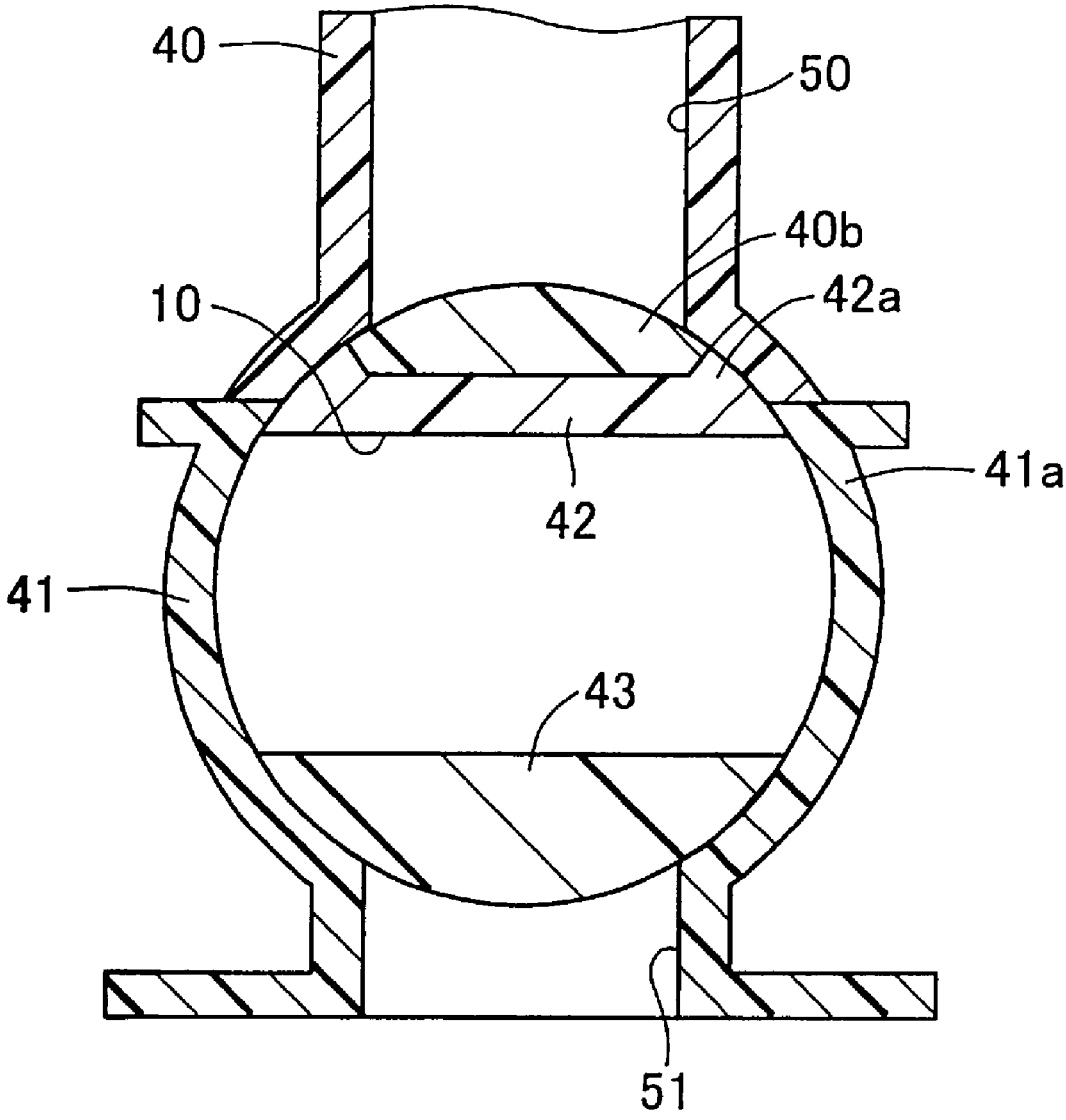
FIG. 5 is a view of assistance in explaining a connection state of the first conveyance part and the second conveyance part.

To connect the first conveyance part 40 to the second conveyance part 41, the circular arc-shaped shutter member 40*b* of the first conveyance part 40 is overlapped with the flat plate shutter part 42 of the second conveyance part 41, as shown in FIG. 5. The curved surface part of the circular arc-shaped shutter member 40*b* faces toward the first conveyance path 50 and the flat surface portion thereof faces toward the second conveyance part 41; therefore, the flat surface portion is overlapped with the flat plate shutter part 42, forming a substantially trapezoidal shape extending in the outer circumferential direction in which shape the circular arc-shaped shutter member 40*b* fits on protruding parts 42*a* of the flat plate shutter part 42. The circular arc-shaped shutter member 40*b* is thus guided roughly to the connecting position.

Figure 6:
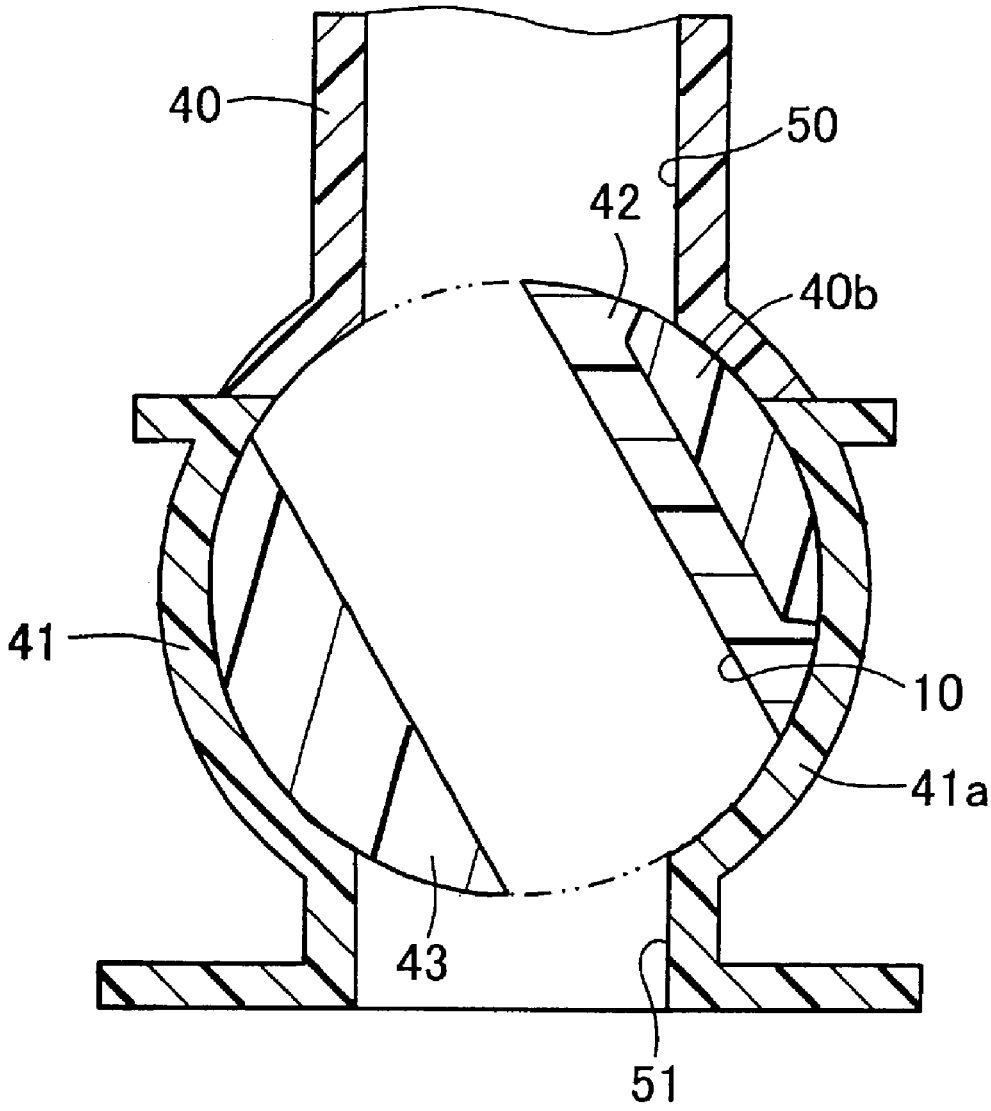
FIG. 6 is a view of assistance in explaining a connection state of the first conveyance part and the second conveyance part.

Next, as shown in FIG. 6, the rotary shutter member 41*b* is rotated around the axial line while keeping internally in contact with the tubular cylinder part 41*a*. If the radius of curvature of the curved surface part of the circular arc-shaped shutter member 40*b* is equal to the radius of the rotary shutter member 41*b*, the curved surface part of the circular arc-shaped shutter member 40*b* constitutes the outer circumferential surface of the rotary shutter member 41*b*, and the circular arc-shaped shutter member 40*b* fits into the region surrounded by the inner circumference of the tubular cylinder part 41*a* and the flat plate shutter part 42 as the rotary shutter member 41*b* rotates.

Figure 7:
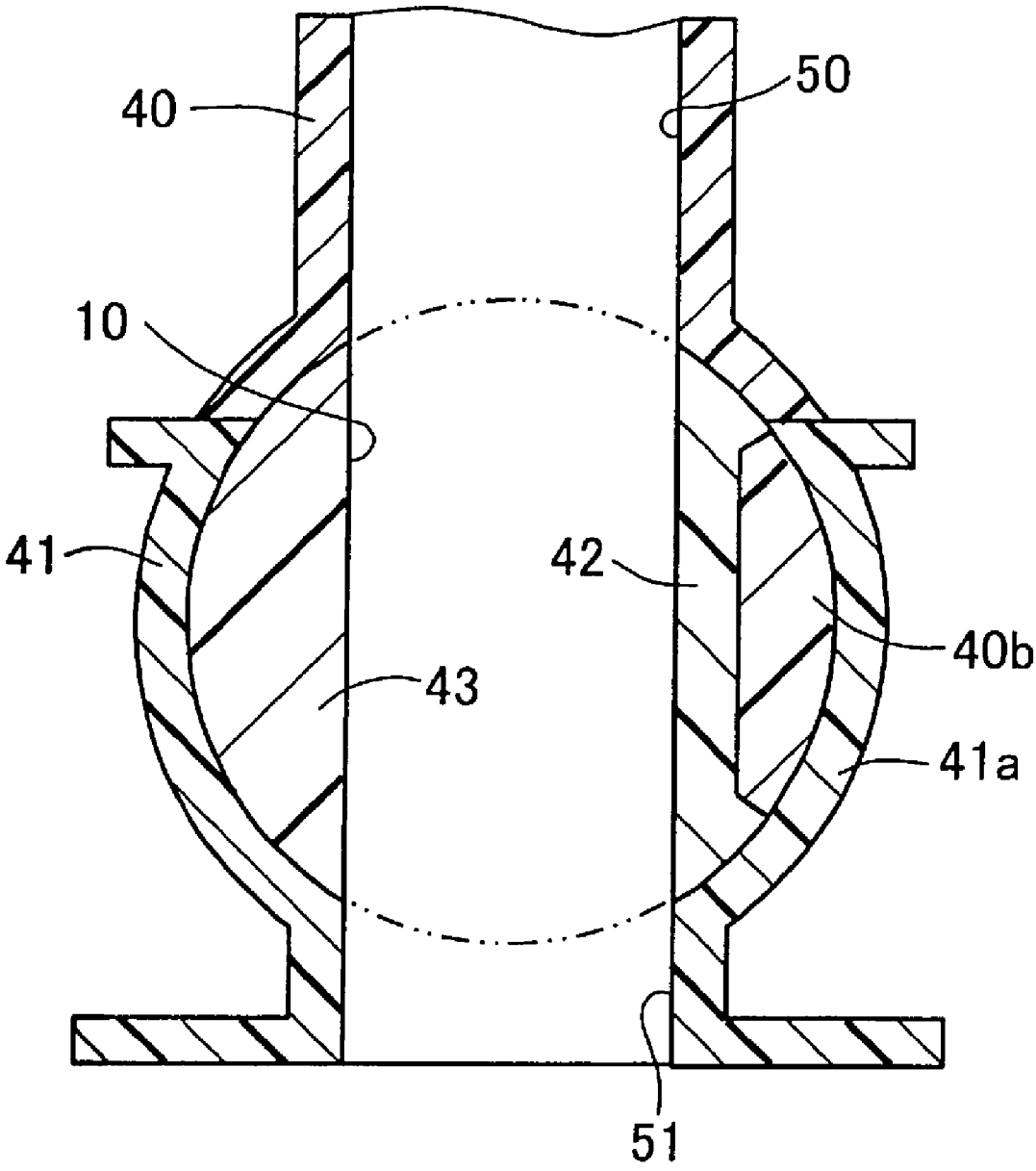
FIG. 7 is a view of assistance in explaining a connection state of the first conveyance part and the second conveyance part.

Further, as shown in FIG. 7, when the rotary shutter member 41*b* rotates 90 degrees clockwise from the state shown in FIG. 5, the through hole 10 of the rotary shutter member 41*b* allows the first conveyance path 50 and the second conveyance path 51 to communicate with each other.

At this time, the circular arc-shaped shutter member 40*b* is fitted into the tubular cylinder part 41*a*, and therefore, the first conveyance part 40 and the second conveyance part 41 stay connected to each other. To detach the first conveyance part 40 and the second conveyance part 41 from each other, the rotary shutter member 41*b* is rotated 90 degrees in the reverse direction, that is, counterclockwise, from the state shown in FIG. 7. After the first conveyance part 40 and the second conveyance part 41 are in such a state as to close the first conveyance path 50 and the second conveyance path 51, that is, in the state shown in FIG. 4, the first conveyance part 40 is detached.

As described above, when the toner cartridge 2 and the developing unit 3 are brought in communication with each other, the circular arc-shaped shutter member 40*b*and also the flat plate shutter part 42 and the circular arc-shaped shutter part 43 of the rotary shutter member 41*b*, are enclosed in the tubular cylinder part 41*a*. Therefore, it becomes possible to reduce the contacting of the shutter members and the toner at the time of replenishing the toner, making the conveyance of the toner easy, and to prevent toner leakage and toner scattering.

The rotation driving of the rotary shutter member 41*b* is performed as follows; the circular arc-shaped shutter member 40*b* is rotated with the circular arc-shaped shutter member 40*b* of the first conveyance part 40 overlapped so that the rotary shutter member 41*b* is moved in accordance with the rotation of the circular arc-shaped shutter member 40*b*.

Figure 8:
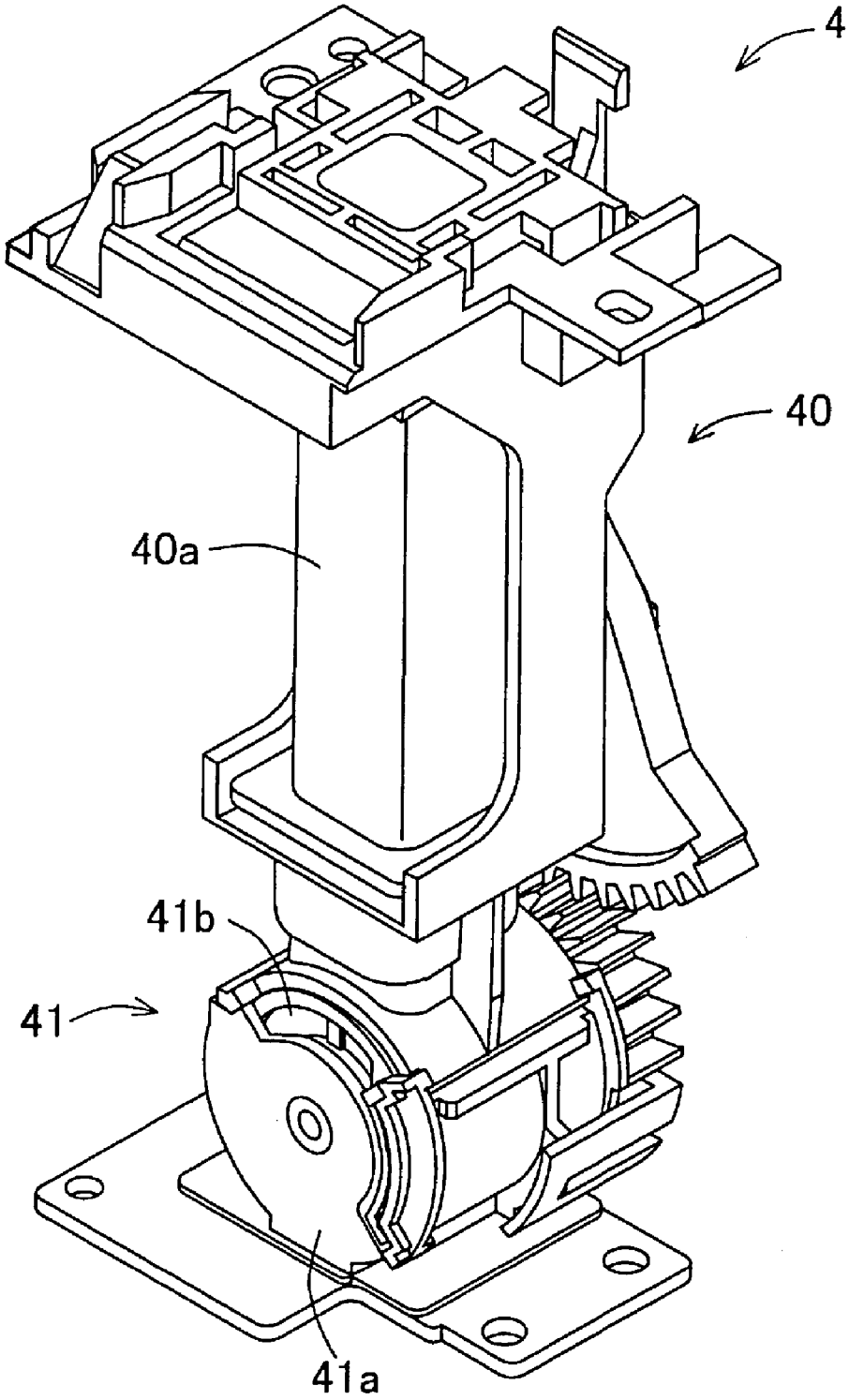
FIG. 8 is a perspective view of the communication unit.
Figure 9:
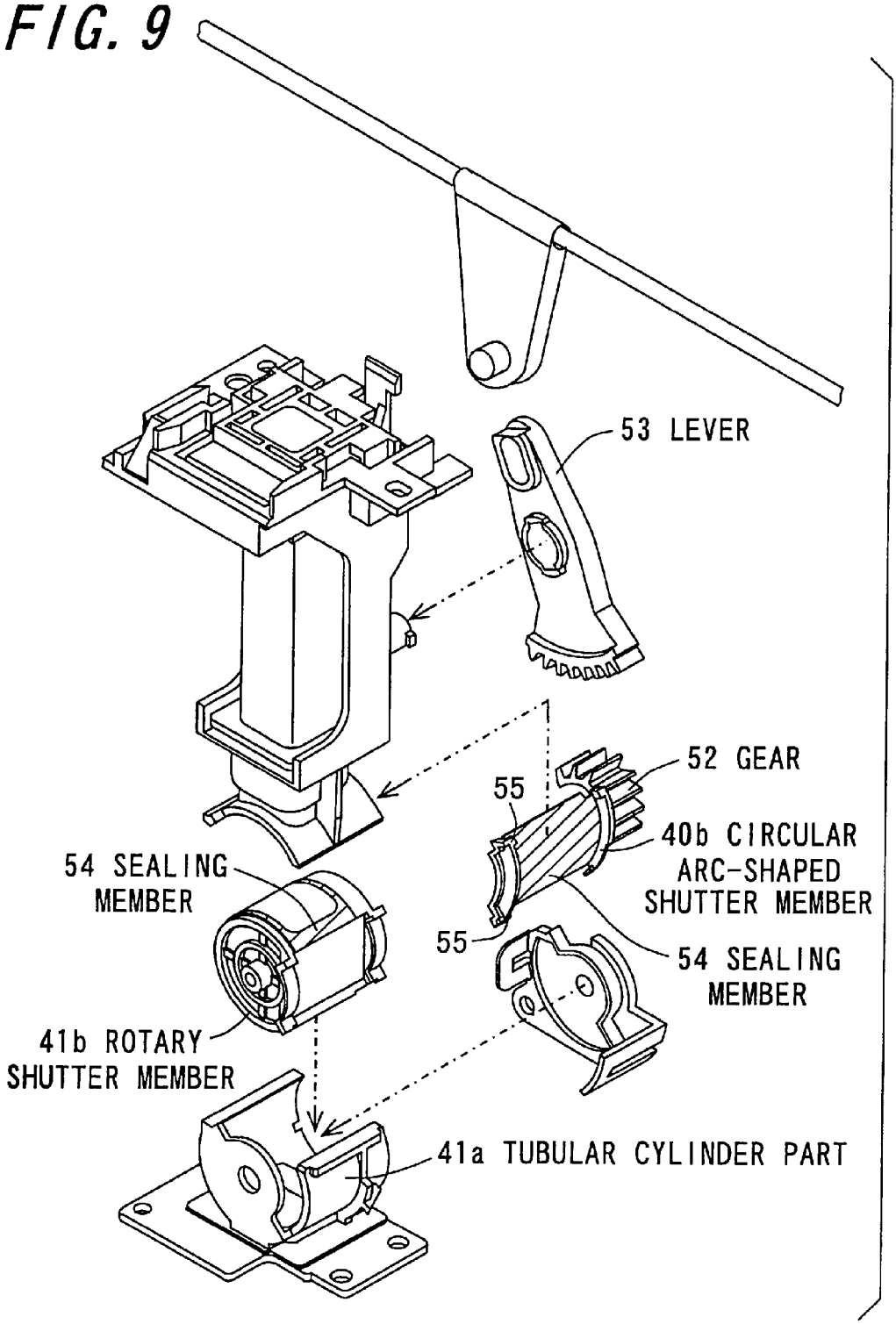
FIG. 9 is a parts-exploded view of the communication unit.

FIG. 8 shows a perspective view of a communication unit 4, and FIG. 9 shows a parts-exploded view of the communication unit 4.

As illustrated in FIG. 9, a gear 52 is provided on the outer side of the circular arc-shaped shutter member 40*b* along the rotation axis, and a geared lever 53 is angularly displaceable on the first main part 40*a* so as to mesh with the gear 52. One end part of the geared lever 53 is provided with a gear while the other end part thereof is provided with a long hole, and the central part thereof is provided with a hole through which a rotation shaft is inserted.

With the hole through which is inserted the rotation shaft provided on the first main part 40*a*, the gear on the one end part is meshed with the gear 52 provided on the circular arc-shaped shutter member 40*b*. A protruding part provided on a rod connected to a later-described lock mechanism is fitted in the long hole in the other end part. A linear motion of the rod is converted into a rotational motion by the geared lever 53 so that the gear 52 of the circular arc-shaped shutter member 40*b* is rotatably driven.

The rotary shutter member 41*b* rotates in accordance with such a rotation operation of the circular arc-shaped shutter member 40*b*.

It is also possible to employ the configuration in which the gear 52 is provided on the rotary shutter member 41*b* and rotatably driven directly by the geared lever 53 so as to move the circular arc-shaped shutter member 40*b* accordingly.

When the image forming apparatus 1 is opened to expose its interior, the first conveyance part 40 is detached from the second conveyance part 41 in association with the apparatus upper portion 1*a*, and when the image forming apparatus 1 is closed, the first conveyance part 40 is connected to the second conveyance part 41 in association with the apparatus upper portion 1*a*, as described above. In the configuration in which the gear 52 is provided on the rotary shutter member 41*b*, the gear 52 remains in the apparatus lower portion 1*b*, while the geared lever 53 provided on the first conveyance part 40 is moved together with the apparatus upper portion 1*a*. For this reason, when the first conveyance part 40 is connected to the second conveyance part 41, it is possible that the geared lever 53 may not mesh with the gear 52 accurately and misalignment may occur in the meshing. If the meshing with the geared lever 53 and the gear 52 is misaligned, the rotary shutter member 41*b* may not rotate sufficiently. Consequently, the conveyance path to replenish a toner may not be secured sufficiently. In addition, when the apparatus is opened next time, the closure of the conveyance path may become insufficient, problems arise such as insufficiency of the replenishment amount, toner leakage, and toner scattering.

For these reasons, it is preferable to employ the configuration in which the gear 52 for rotation drive is provided on the first conveyance part 40 side, as in the present embodiment.

If a toner gets into the gap between the inner circumferential surface of the tubular cylinder part 41*a* and the outer circumferential surfaces of the rotary shutter member 41*b* and the circular arc-shaped shutter member 40*b* when rotating the rotary shutter member 41*b* to communicate the first and second conveyance paths with each other, the toner that has entered the gap scatters around when rotating the rotary shutter member 41*b* to close the first and second conveyance paths. To prevent the toner from entering the gap between the inner circumferential surface of the tubular cylinder part 41*a* and the outer circumferential surfaces of the rotary shutter member 41*b* and the circular arc-shaped shutter member 40*b*, it is preferable to attach a sealing member 54 having elasticity on the outer circumferential surfaces of the rotary shutter member 41*b* and the circular arc-shaped shutter member 40*b*. Known elastic materials may be used for the sealing member 54, and it is preferable to use, for example, Moltplain, urethane-based rubber, and fluororesin.

The outer shape of the tubular cylinder part 41*a* may not be a tubular shape, and it is sufficient that an inner space is provided so that the rotary shutter member 41*b* can rotate inside.

The tubular cylinder part 41*a* is a molded product made of resin. Therefore, when the outer shape is a tubular shape, the inner space and the outer shape become the same shape, and the overall material thickness becomes equal. In a resin molded product with variation in the material thickness, a dent or the like is formed particularly at a thick portion. For example, if the outer shape of the tubular cylinder part 41*a* is made in a rectangular parallelepiped shape, the material thickness becomes thick at the angular portions, and therefore dents are formed on the inner circumferential surface side. In this case, when the rotary shutter member 41*b* is rotated, a toner tends to enter the dents easily. For this reason, it is preferable that the outer shape be a tubular shape.

The circular arc-shaped shutter member 40*b* and the rotary shutter member 41*b* are also made by resin molding, and it is preferable to contain a conductive material such as carbon black. When the shutter members make contact with a toner, electrostatic adhesion occurs and aggregation of the toner occurs at the shutter portions, which prevents toner conveyance. Thus, when the shutter members contain a conductive material, electrostatic adhesion is suppressed, and conveyance of the toner is made easier.

It is preferable that the content of the conductive material be, for example, 3 parts by weight to 30 parts by weight based on 100 parts by weight of molded resin.

When the content of conductive material is less than 3 parts by weight, electrostatic adhesion cannot be prevented sufficiently. On the other hand, if the content is greater than 30 parts by weight, moldability becomes poor.

It is preferable that the surfaces of the circular arc-shaped shutter member 40*b* and the rotary shutter member 41*b* have a 10-point mean surface roughness Rz of 2 μm or less.

The average particle size of the toner used for the electrophotographic system has become smaller, and the toner particle size distribution used shows the existence of a toner having a diameter of about 2 μm. If the shutter members have a surface roughness of greater than 2 μm, such a toner with a very small particle size gets into the surface irregularity, causing physical adherence and resulting in aggregation of the toner on the shutter surface portions. By setting the surface roughness of the shutter members to be equal to or less than 2 μm, adherence of the toner to the shutter surface portions is suppressed, and the conveyance of the toner is made easy.

The shutter members may be made to have a 10-point mean surface roughness Rz of 2 μm or less by polishing the surfaces of the shutter members with abrasive having a particle size of 1 μm or less, for example.

Hooked claw-shaped engaging parts 55 are provided at the four corners of the circular arc-shaped shutter member 40*b*, and these are engaged with a lower portion of the first main part 40*a* to prevent detachment from the first main part 40*a*. In addition, also when the circular arc-shaped shutter member 40*b* is rotated and enclosed in the tubular cylinder part 41*a*, some of the engaging parts 55 are engaged with the lower portion of the first main part 40*a* to keep the connection state between the first conveyance part 40 and the second conveyance part 41.

Figure 10:
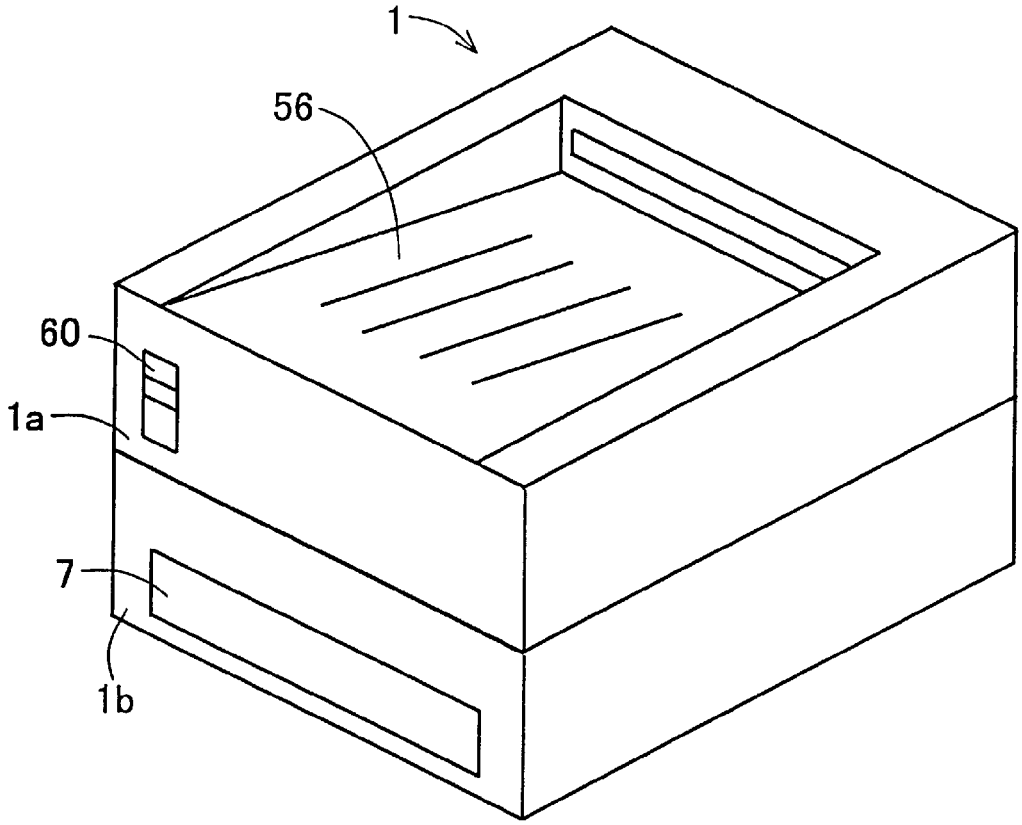
FIG. 10 is a perspective view showing an outer shape of the image forming apparatus.

FIG. 10 is a perspective view showing the outer shape of the image forming apparatus 1.

In the present embodiment, a paper receiving tray 56 is provided on the top surface portion of the apparatus, and this is an image forming apparatus with compact design, as illustrated in the cross-sectional view of FIG. 1.

As described above, the image forming apparatus 1 is adapted to be separated into the apparatus upper portion 1*a* and the apparatus lower portion 1*b* so as to open the apparatus to expose an interior thereof. It should be noted, however, that the exposure of the interior is limited to the time of maintenance or the like, and a lock mechanism is provided so that the apparatus cannot be opened during image formation.

The lock mechanism includes one with an electric structure and one with a mechanical structure. The present embodiment adopts a lock mechanism with a mechanical structure in order to link the open and close operation of the shutters in the communication units 4 with the operation of the lock mechanism.

The present embodiment employs a mechanism using a lever action as the lock mechanism of the mechanical structure. When the interior of the image forming apparatus 1 needs to be exposed, the user draws a lock release lever 60 provided on a side surface of the apparatus upper portion 1*a*, outward of the apparatus to unlock the apparatus upper portion 1*a* and the apparatus lower portion 1*b*, and pulls up the apparatus upper portion 1*a* with the hinge provided opposite the lock release lever 60 as the axis, whereby the apparatus can be opened.

Figure 11:
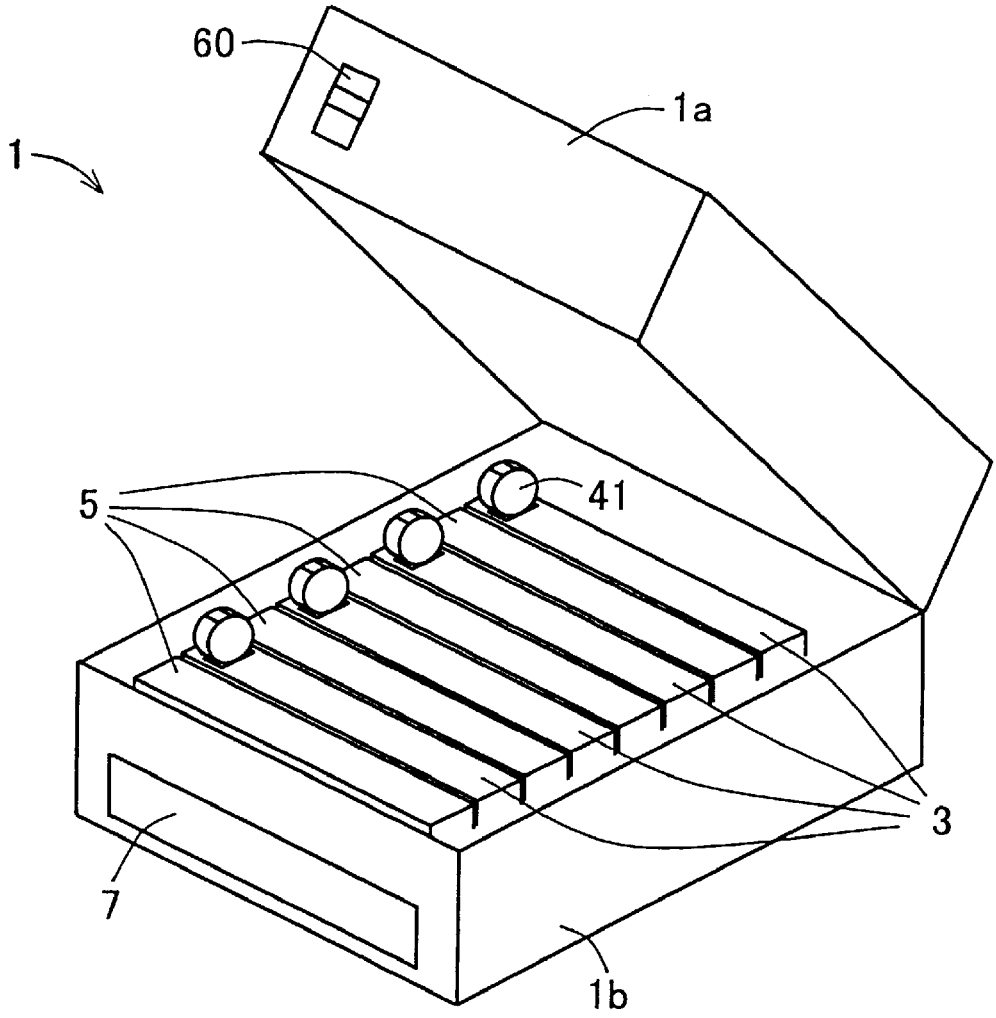
FIG. 11 is a perspective view showing the outer shape of the image forming apparatus with its interior exposed.

FIG. 11 is a perspective view showing the outer shape of the image forming apparatus 1 with its interior exposed.

The second conveyance parts 41 of the communication units 4 are connected to the developing units 3 in the apparatus lower portion 1*b*. In addition, the openings of the tubular cylinder parts 41*a* are closed by the rotary shutter members 41*b*.

Although not shown in the figure, the first conveyance parts 40 of the communication units 4 are connected to the toner cartridges 2 in the apparatus upper portion 1*a* and in addition, the openings of the tubular cylinder parts 41*a* are closed by the circular arc-shaped shutter members 40*b*.

The detailed open and close operations of the circular arc-shaped shutter member 40*b* and the rotary shutter member 41*b* have already discussed above. Therefore, the linkage of the lock mechanism with the shutter members in the image forming apparatus 1 will be discussed below.

As shown in FIG. 11, in order to close the shutters in both of the first conveyance part 40 and the second conveyance part 41 and further to separate the first conveyance part 40 and the second conveyance part 41 from each other when the apparatus is opened, the shutters need to be closed so that the first conveyance part 40 and the second conveyance part 41 become separable from each other at the time of releasing the locked state between the apparatus upper portion 1*a* and the apparatus lower portion 1*b* through the lock mechanism.

Figure 12:
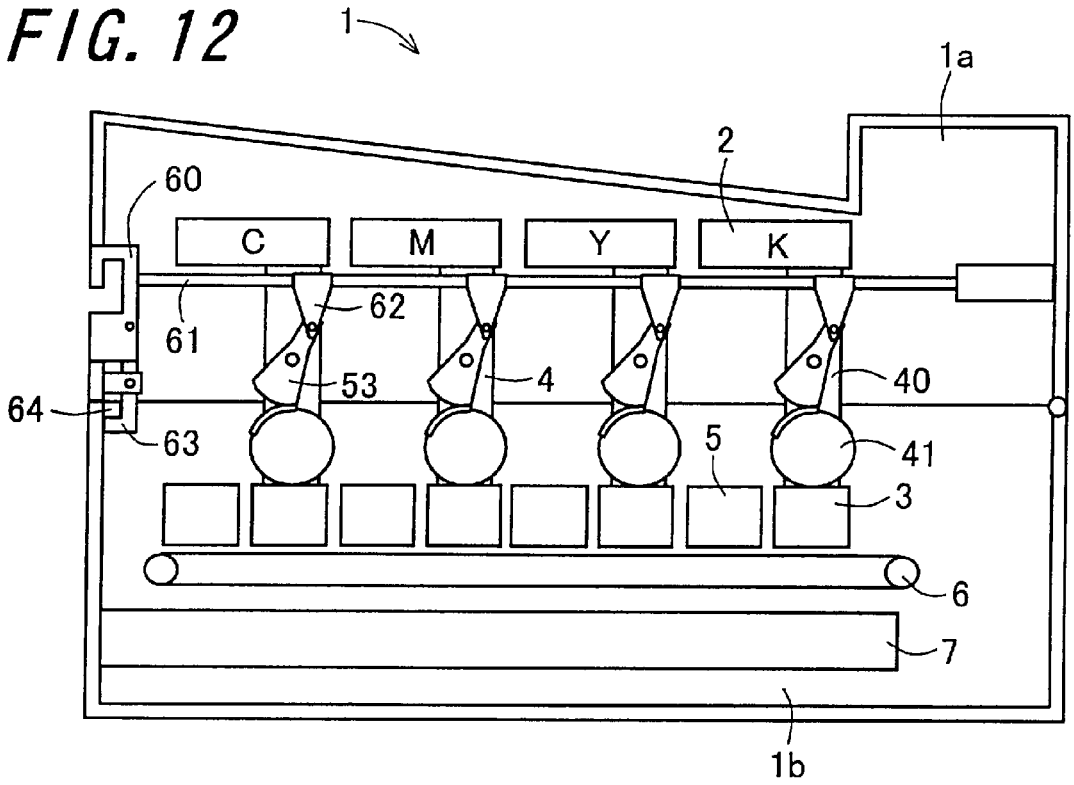
FIG. 12 is a cross-sectional view showing the image forming apparatus with an apparatus upper portion and an apparatus lower portion locked.
Figure 13:
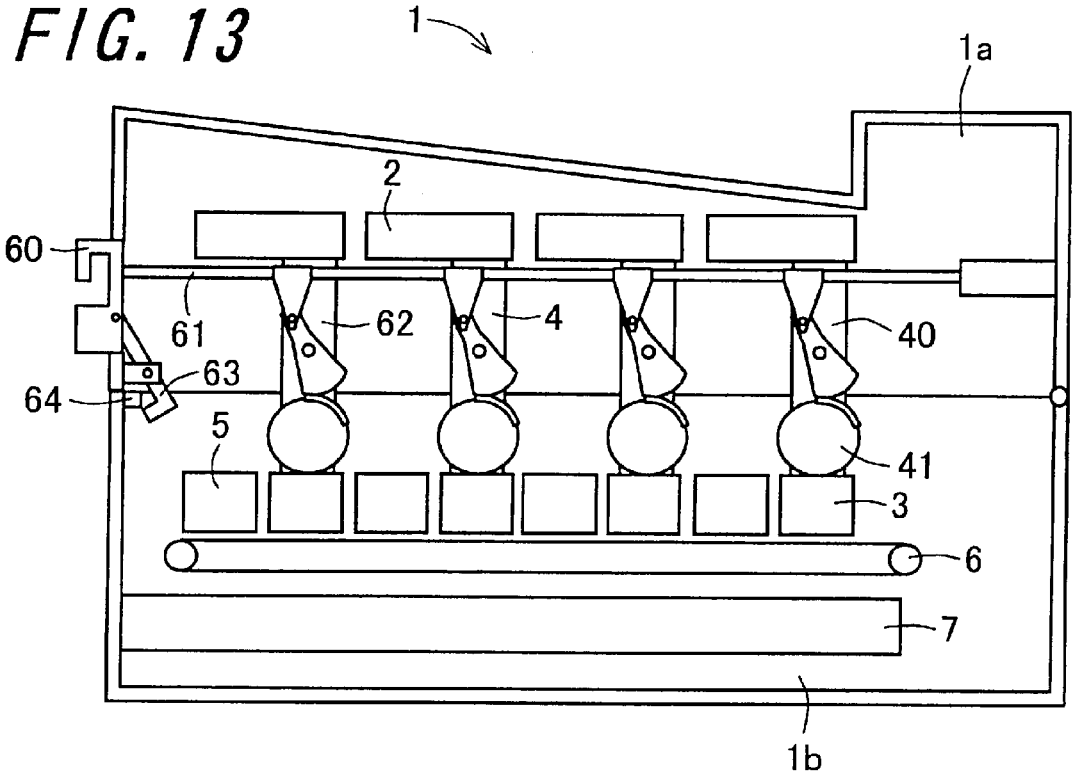
FIG. 13 is a cross-sectional view showing the image forming apparatus with the apparatus upper portion and the apparatus lower portion unlocked.

FIG. 12 is a cross-sectional view showing the image forming apparatus 1 with the apparatus upper portion 1*a* and the apparatus lower portion 1*b* locked. FIG. 13 is a cross-sectional view showing the image forming apparatus 1 with the apparatus upper portion 1*a* and the apparatus lower portion 1*b* unlocked.

The lock release lever 60 is a handle-drawing type release lever that can be gripped from the apparatus outside, which moves in a horizontal direction when the image forming apparatus 1 is in an installed state.

The lock release lever 60 is connected to one end part of the rod 61 shown in FIG. 9 in the interior of the apparatus. The sliding movement of the rod 61 in a horizontal direction and the horizontal movement of the lock release lever 60 are linked with each other. Moreover, the rod 61 extends parallel to the array direction of the developing units 3 arranged in tandem, and the other end part is hooked on an inner wall of the apparatus that is opposite the lock release lever 60.

The communication units 4 connecting the developing units 3 and the toner cartridges 2 are arranged parallel to the rod 61, and the geared levers 53 and the rod 61 are connected via connecting members 62. The connecting member 62 is a substantially triangular plate-shaped member. The connecting member 62 is fixed to the rod 61 at its bottom side portion, and its protruding part protruding from the apex perpendicularly to the plate surface fits into the long hole in the other end part of the geared lever 53. A linear motion of the rod 61 in a horizontal direction is converted into a rotational motion by the geared lever 53 so that the gear 52 of the circular arc-shaped shutter member 40*b* is rotated.

As a result, the rod 61 slides in a horizontal direction by the movement of the lock release lever 60, and accordingly, the geared lever 53 rotates, rotating the circular arc-shaped shutter member 40*b*.

To close the shutters of the communication unit 4 reliably, it is necessary to rotate the circular arc-shaped shutter member 40*b* and the rotary shutter member 41*b* by 90°. For this purpose, the sliding stroke of the rod 61 is set at ¼ of the outer circumference of the rotary shutter member 41*b*.

Thus, by pulling out the lock release lever 60 by a necessary stroke of the rod 61, the shutters of the communication unit 4 are closed.

The lock mechanism for the apparatus upper portion 1*a* and the apparatus lower portion 1*b* is brought into a locked state when a hook 63 pivotally provided on the lock release lever 60 engages with a claw 64 which is provided on the inner wall of the apparatus lower portion 1*b* and protrudes inward of the apparatus, while the lock mechanism is brought into a release state when the hook 63 is detached from the claw 64.

The hook 63 is connected pivotally to the lock release lever 60 at the opposite end part of its bent part, and the hook 63 is supported by a rotation shaft perpendicularly crossing the moving direction of the lock release lever 60 at the center part. When the lock release lever 60 moves in a horizontal direction, the bent part of the hook 63 moves in a horizontal direction that is the opposite direction to the lock release lever 60 due to the rotation shaft.

Specifically, when the lock release lever 60 is pulled outward of the apparatus, the hook 63 moves inward of the apparatus. Accordingly, the hook 63 is disengaged from the claw 64 of the apparatus lower portion 1*b*, and the apparatus upper portion 1*a* and the apparatus lower portion 1*b* are unlocked. On the other hand, when the lock release lever 60 is pushed inward of the apparatus in a state in which the apparatus upper portion 1*a* is overlapped with the apparatus lower portion 1*b*, the hook 63 moves outward of the apparatus. Accordingly, the bent part of the hook 63 engages with the claw 64 of the apparatus lower portion 1*b*, and the apparatus upper portion 1*a* and the apparatus lower portion 1*b* are locked.

In this way, when the lock mechanism (the lock release lever 60) of the apparatus upper portion 1*a* and the apparatus lower portion 1*b* is operated, the rod 61 moves horizontally by a predetermined stroke in conjunction with this operation to thereby rotate the circular arc-shaped shutter member 40*b* and the rotary shutter member 41*b*.

Figure 14:
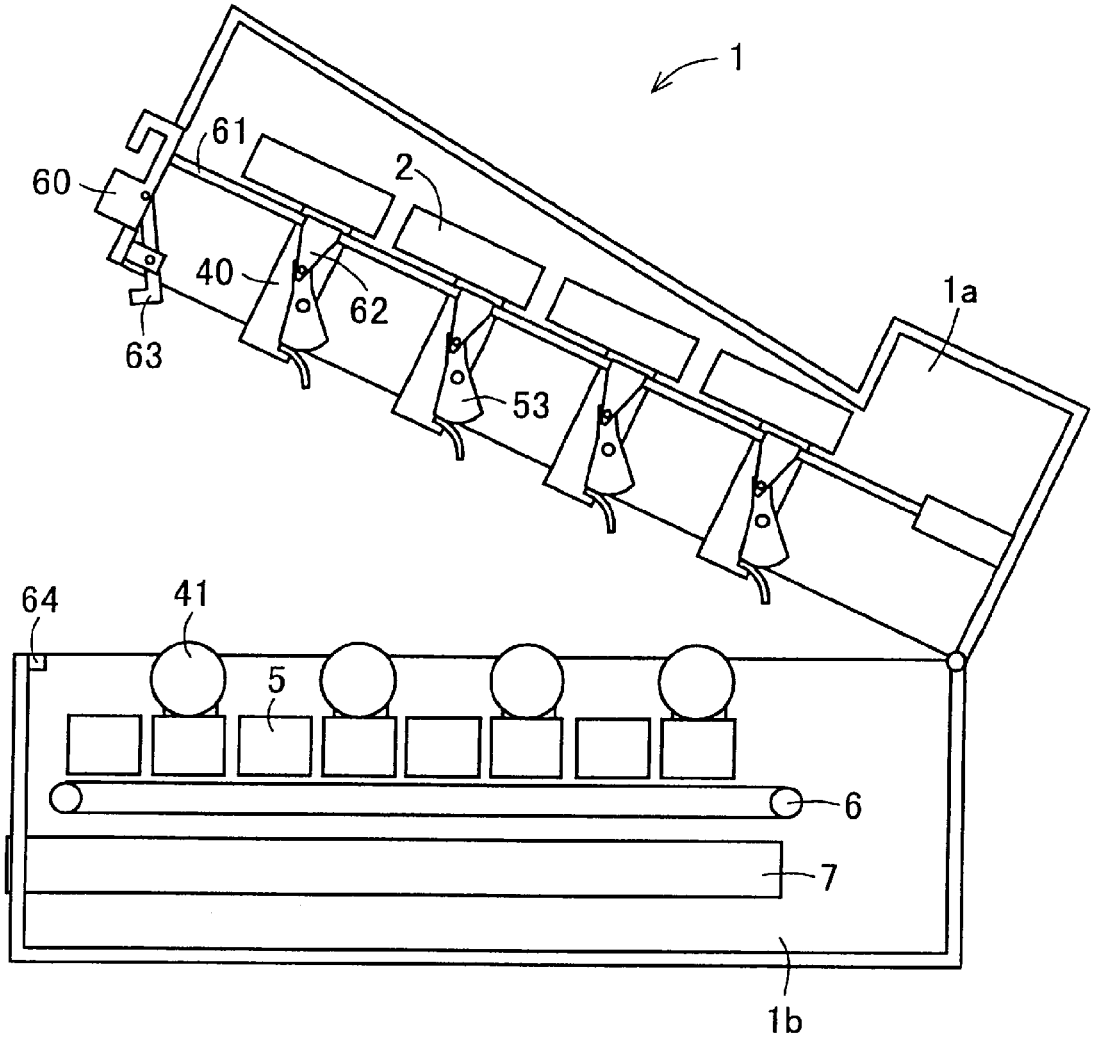
FIG. 14 is a cross-sectional view illustrating the image forming apparatus with the apparatus upper portion opened after the lock is released.

FIG. 14 is a cross-sectional view illustrating the image forming apparatus 1 with the apparatus upper portion 1*a* opened after the lock is released.

When the apparatus upper portion 1*a* is lifted upward in an unlock state, in other words, in a state in which the hook 63 is disengaged from the claw 64 of the apparatus lower portion 1*b*, the apparatus upper portion 1*a* opens with the hinge provided at the opposite side of the lock release lever 60 being the axis, allowing the interior of the apparatus to be exposed.

At this time, the openings positioned at lower portions of the first conveyance parts 40 of the communication units 4 disposed on the apparatus upper portion 1*a* side are closed by the circular arc-shaped shutter members 40*b* that have been rotated and shifted. As a result, even if the apparatus upper portion 1*a* is lifted and shifted, the falling or scattering of the toner from the toner cartridges 2 does not occur.

The rotary shutter members 41*b* of the apparatus lower portion 1*b* also rotate in accordance with the circular arc-shaped shutter members 40*b* so that both the openings positioned at upper portions of the tubular cylinder parts 41*a* and the conveyance paths to the developing units 3 positioned at lower portions thereof are closed.

In a state in which the image forming apparatus 1 is closed and locked, the circular arc-shaped shutter member 40*b* and the rotary shutter member 41*b* are enclosed in the tubular cylinder part 41*a*, and therefore do not make contact with the toner being conveyed. Accordingly, the toner does not adhere to the outer circumferential surface of the flat plate shutter part 42 when the apparatus is brought into an unlocked state, with the result that leakage and scattering of toner do not occur.

It should be noted that, in the foregoing embodiment, the communication units 4 are disposed so as to replenish a toner from the toner cartridges 2 to the developing units 3 and make their inner spaces communicate with each other, but the location at which the communication units 4 may be disposed is not limited to the location stated above, and the communication units 4 may be disposed at any location as long as different containers are allowed to be in communication with each other. For example, it is possible to dispose the communication units 4 between the developing units 3 and a used toner box.

The conveyance direction of a toner is set to be in a direction from the first conveyance part 40 toward the second conveyance part 41 in the present embodiment. However, the conveyance direction of a toner may be in a direction from the second conveyance part 41 toward the first conveyance part 40.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

a toner cartridge to store a toner;

a developing device to develop an electrostatic latent image formed on a surface of a photoreceptor by the toner; and a toner conveyance unit to replenish a toner from the toner cartridge to the developing device, the image forming apparatus forming an image by transferring and fixing a developed toner image onto a recording medium, the toner conveyance unit having a first conveyance part connected to the toner cartridge and provided with a feed port for a toner from the toner cartridge, and a second conveyance part connected to the developing device and provided with a replenishment port for a toner to the developing device, the toner conveyance unit having an apparatus upper portion including the toner cartridge and the first conveyance part and an apparatus lower portion including the developing device and the second conveyance part, and a hinge mechanism between the upper and lower portions, wherein the first conveyance part is separated from the second conveyance part by operation of the hinge mechanism, the toner conveyance unit including a lock mechanism to lock the apparatus upper portion and apparatus lower portion closed, in a state locked by the lock mechanism, the first conveyance part and the second conveyance part being connected to each other, and the feed port of the first conveyance part and the replenishment port of the second conveyance part are opened by shutter members, allowing for a toner replenishment, and in a lock-released state, the feed port of the first conveyance part and the replenishment port of the second conveyance part being closed by the shutter members, allowing the first conveyance part and the second conveyance part to be separable from each other.

2. The image forming apparatus of claim 1, wherein the apparatus upper portion and the apparatus lower portion are separated from each other and the developing device is exposed with the apparatus upper portion opened upward.

3. The image forming apparatus of claim 1, wherein the lock mechanism is coupled to the shutter members on the feed port of the first conveyance part and the replenishment port of the second conveyance part and the shutter members open and close in conjunction with movement of the lock mechanism.

4. The image forming apparatus of claim 3, wherein the image forming apparatus is of a tandem type with a plurality of toner cartridges and a plurality of developing devices to be capable of forming a color image.

5. The image forming apparatus of claim 4, wherein the lock mechanism is coupled via a rod-shaped member to the shutter members on the feed port of the first conveyance part and the replenishment port of the second conveyance part.

6. The image forming apparatus of claim 1, wherein the shutter members are made of a resin material containing a conductive material.

7. The image forming apparatus of claim 1, wherein surfaces of the shutter members each have a 10-point mean surface roughness Rz of 2 μm or less.

8. The image forming apparatus of claim 1, wherein a sealing member having elasticity is provided on surfaces of the shutter members.

9. The image forming apparatus of claim 1, wherein a junction of the shutter members has a substantially trapezoidal shape extending in an outer circumferential direction of the shutter members.

* * * * *